United States Patent [19]

Singh

[11] 4,009,814

[45] Mar. 1, 1977

[54] WEB ACCUMULATOR

[75] Inventor: Balbir Singh, Media, Pa.

[73] Assignee: Scott Paper Company, Philadelphia, Pa.

[22] Filed: Sept. 8, 1975

[21] Appl. No.: 611,064

[52] U.S. Cl. ..... 226/113; 226/119
[51] Int. Cl.² ..... B65H 17/42
[58] Field of Search ..... 226/91, 113, 114, 118, 226/119

[56] References Cited

UNITED STATES PATENTS

| | | | |
|---|---|---|---|
| 2,059,979 | 11/1936 | Aiken | 226/119 |
| 2,780,346 | 2/1957 | Roughsedge | 226/119 X |
| 3,084,841 | 4/1963 | Hata | 226/113 |
| 3,526,563 | 9/1970 | Schott | 226/113 X |
| 3,583,619 | 6/1971 | Shepherd | 226/113 |
| 3,796,360 | 3/1974 | Alexeff | 226/119 |
| 3,883,389 | 5/1975 | Schott | 226/113 X |

*Primary Examiner*—Richard A. Schacher
*Attorney, Agent, or Firm*—Joseph H. Yamaoka; William J. Foley

[57] ABSTRACT

Disclosed is a web accumulator for accumulating and discharging a reserve portion of a continuous web passing through the accumulator. The accumulator, which is particularly useful for handling weak webs such as sanitary or tissue paper, includes first and second sets of rotatably mounted web rolls, each of which is partially wrapped by the web when the web is looped alternately from a roll of the first set to a roll of the second set in consecutive order. The second set of web rolls is mounted for movement towards and away from the first set of web rolls to discharge and accumulate the reserve portion of the web, and the accumulator preferably includes drive means separate from the web for driving each web roll at the speed of the web passing over it at all times including when it is accumulating or discharging. The drive means is preferably provided by a drive pulley operably connected to each web roll and preferably having the same size as its respective web roll, an endless flexible belt engaging the drive pulleys in the same sequence that the web engages the web rolls, inlet drive means for rotating the first web roll, exit drive means for rotating the exit web roll, and take-up means for taking up and releasing slack in the drive belt occurring when the second set of rolls moves towards or away from the first set.

8 Claims, 5 Drawing Figures

WEB ACCUMULATOR

BACKGROUND OF THE INVENTION

1. Field of the Invention

The invention relates to web accumulators for accumulating and discharging a reserve portion of a continuous web passing through the accumulator to enable continuous operation of processing stations on either or both sides of the accumulator when the speed of the web moving through the processing stations temporarily varies between the two stations. The invention is particularly useful for handling weak webs, such as sanitary or tissue paper.

2. Description of the Prior Art

In many processing operations involving continuous lengths of web material, there are temporary differences in operating speeds between two adjacent operating stations. For example, in the manufacture of sanitary or tissue paper products, it is common to unwind paper from a large parent roll and conduct it through a finished or converting operation. In such operations, it is often desirable to rewind the paper into rewound rolls of a specific size which are not necessarily the same size as the parent rolls, resulting in either the parent roll being depleted before the rewound roll is completed or the rewound roll being completed before the parent roll is depleted. The operation is then maintained by splicing a new parent roll to the end of the paper or by starting a new rewound roll, either of which would require halting the operation unless a reserve portion of the web had been accumulated for continued operation of the rewound roll or a reserve portion of the web can be accumulated while a new rewound roll is prepared. This problem is quite old and is generally solved through use of web accumulators.

The typical accumulator for such uses is the festooning type, such as that disclosed in U.S. Pat. No. 3,645,463. Festooning type accumulators typically consist of a set of fixed web rolls and a set of movable web rolls which are moved towards and away from the fixed rolls. The web is looped alternately from a roll of the first set to a roll of the second set in consecutive order. The movable set of rolls are typically attached to a single carriage which is moved away from the fixed rolls for accumulating a reserved portion of the web and moved toward the fixed rolls for discharging the accumulated reserve portion of the web. The amount of web which can be accumulated is generally quite large for the size of the apparatus, being equal to twice the movement distance of the carriage times the number of rolls mounted on the carriage. Examples of prior art web accumulators are disclosed in U.S. Pat. Nos. 1,261,056; 3,693,860; 3,698,613; 3,700,157; 3,734,370; 3,743,153; and Re. 27,139.

A number of shortcomings exist in the web accumulators of the prior art, particularly for use with weak webs like sanitary or tissue paper. For example, most employ freely rotatable rolls which obtain their rotational force from the web moving across them. Since the portion of the web passing about each roll will be moving at a different speed than the portions of the web passing about other rolls during accumulating or discharging, the use of the web itself to rotate the rolls has been thought in the past to be the only practicable way to drive the rolls. Many of the prior art accumulators are used for accumulating metal strips and other strong web materials where the strong web materials can be depended upon to rotate the rolls. However, weak webs such as sanitary or tissue paper cannot always be relied upon to drive the rolls since the paper is inclined to break. Another common shortcoming of the typical prior art accumulators is their dependence upon the web material to drive the carriage towards the fixed rolls. Again, weak web materials such as sanitary or tissue paper cannot always be relied upon for transmitting carriage driving forces.

It is therefore an object of the invention to provide a web accumulator in which the web is festooned over rolls and each roll is driven by means separate from the web at the speed of the web in contact with it at all times including when it is accumulating or discharging. It is a further object of the invention to provide a web accumulator in which the web is festooned over rolls and in which one set of rolls is driven towards and away from the other set of rolls by drive means separate from the web in response to any difference in speed between the web entering the accumulator and the web leaving the accumulator. And it is a further object of the invention in its preferred embodiment to provide a web accumulator which accomplishes both of the above objects in a single apparatus.

SUMMARY OF THE INVENTION

These and other objects are accomplished by the apparatus of the invention which includes first and second sets of rotatably mounted web rolls, each of which is partially wrapped by a web when the web is festooned about the rolls by being wound alternately from a roll of the first set to a roll of the second set in consecutive order. The second set of rolls is mounted, preferably to a carriage, for movement towards and away from the first set of rolls. Each web roll is preferably provided with a drive pulley operably connected to it and having a pitch diameter equal to the diameter of the web roll it drives. In the preferred embodiment the accumulator further includes a plurality of take-up pulleys rotatably mounted in a mirrored relationship to the drive pulleys with one set of the take-up pulleys mounted on the carriage. An endless flexible drive belt operably engages the drive pulleys in the same sequence as the web engages the web rolls and continues into operable engagement with the take-up pulleys in a mirrored relationship to its engagement with the drive pulleys.

The first web roll in the accumulator is preferably driven by inlet drive means at the inlet speed of the web entering the accumulator, and the last web roll in the accumulator is preferably driven by exit drive means at the exit speed of the web leaving the accumulator. The inlet drive pulley and exit drive pulley being operably connected to their respective web rolls are also driven at the inlet speed and exit speed, respectively. When the exit speed is faster than the inlet speed, the drive belt responds to the speed difference by decreasing its festooned length about the drive pulleys and thereby moves the carriage towards the first set of web rolls and discharges the reserve portion of the web. When the web exit speed is slower than the web inlet speed, the drive belt responds to the speed difference by decreasing its festooned length about the take-up pulleys and thereby moves the carriage away from the first set of web rolls and accumulates a reserve portion of the web. When the carriage is being moved either away from or towards the first set of web rolls, each web roll is automatically driven at a different speed by the drive belt to match the speed of the web in contact with the roll.

The invention in its preferred embodiment automatically and instantaneously accumulates and discharges a reserve portion of the web in response to speed differences between the inlet and the outlet of the web passing through the accumulator, and it automatically drives each web roll at the speed of the web in contact with it, all without depending upon the force being provided by the web itself. Thus the invention is particularly advantageous for use with weak webs such as sanitary or tissue paper.

DESCRIPTION OF THE PREFERRED EMBODIMENTS

Figure 1:
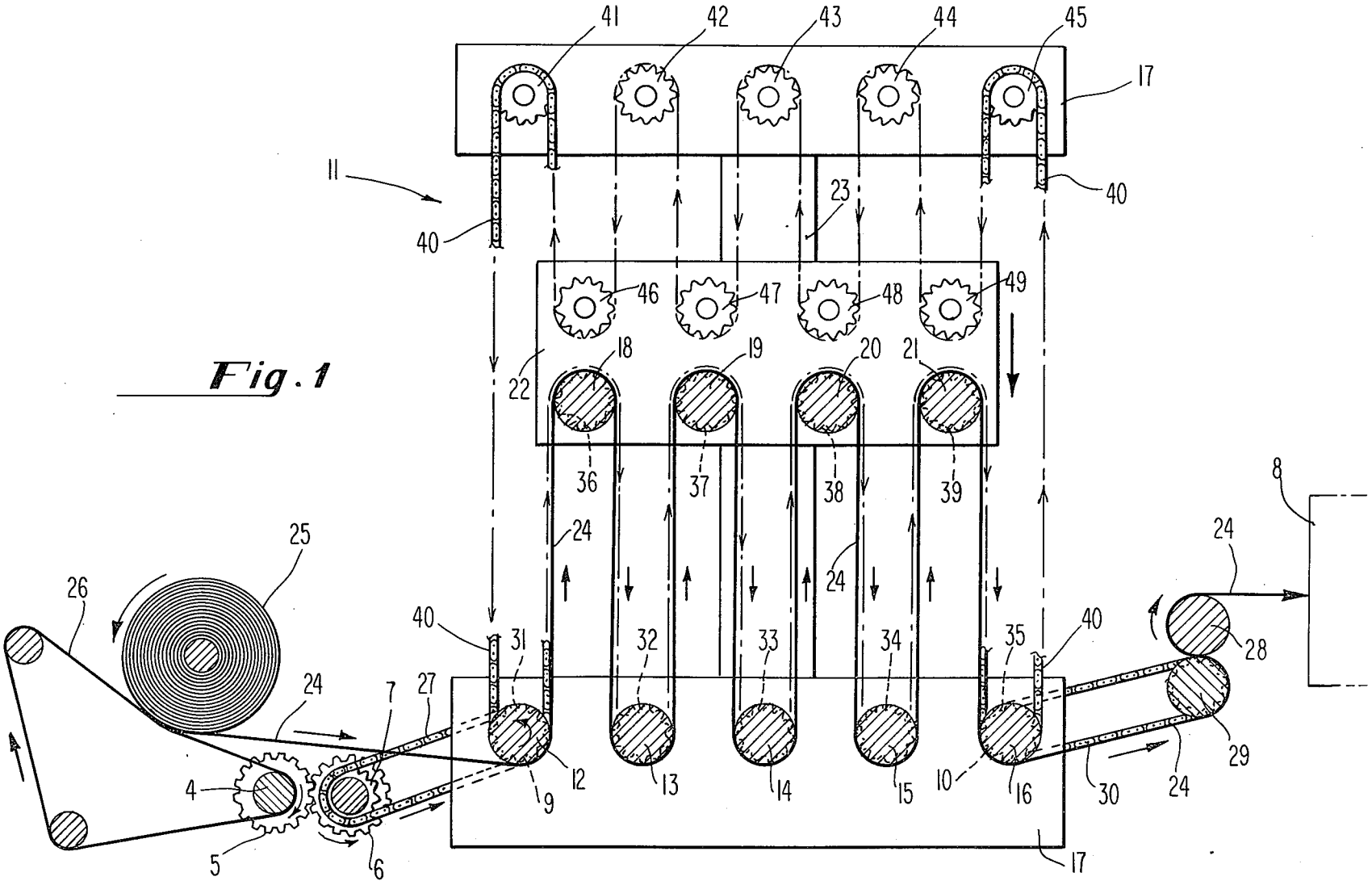
FIG. 1 is a side elevational view of the web accumulator of the invention in schematic form.
Figure 2:
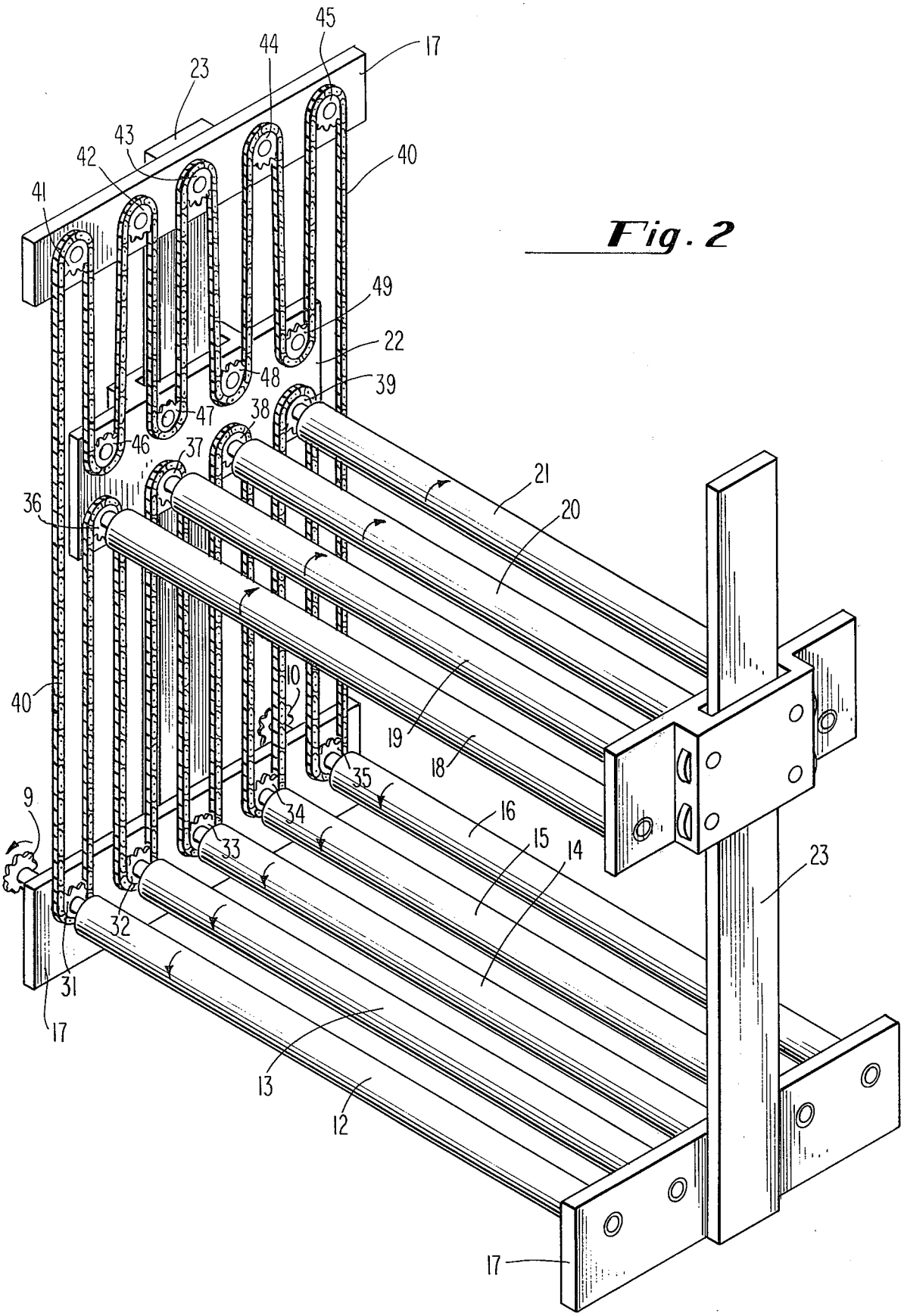
FIG. 2 is an isometric view of the accumulator illustrated in FIG. 1.

Referring to FIGS. 1 and 2, the accumulator of the invention is indicated generally by the numeral 11. It consists of a first set of web rolls 12–16 rotatably mounted near the bottom of frame 17 and a second set of web rolls 18–21 rotatably mounted on a carriage 22. The carriage 22 is mounted for movement towards and away from the first set of web rolls 12–16 along conventional guide means such as guide members 23 on both sides of frame 17.

A continuous web 24 is passed through the accumulator 11 by partially wrapping about inlet web roll 12, looping up over web roll 18, back down and about web roll 13, and so forth until it wraps about exit web roll 16 and passes from the accumulator 11. The web 24 is shown being unwound from a parent roll 25 through such means as a driving belt 26 in contact with the periphery of the parent roll 25. Inlet drive means interconnects driving belt 26 with inlet web roll 12 to drive inlet roll 12 at the same surface speed as web 24 is unwound from parent roll 25. Inlet drive means is provided by reversing gears 5 and 6, chain drive 27 and sprockets 7 and 9. Reversing gear 5 is mounted on a common shaft with driving belt 4, and reversing gear 6 is mounted on a common shaft with sprocket 7. Sprocket 9 is mounted on a common shaft with inlet web roll 12. Driving belt 26 and inlet drive means are both driven by conventional motor means or other drive means (not illustrated).

The web 24 is driven by conventional S-rolls 28 and 29 after it leaves accumulator 11. After passing through S-rolls 28 and 29, Web 24 continues into operational station 8, which can be a rewinder or any other processing equipment. Exit drive means operably interconnect S-rolls 28 and 29 with exit web roll 16 to drive exit web roll 16 at the same surface speed as web 24 is driven by S-rolls 28 and 29. Exit drive means is provided by drive chain 30 and sprockets 10 and 29. Sprocket 10 is mounted on a common shaft with exit web roll 16, and sprocket 29 is mounted on a common shaft with S-roll 29. Conventional motor means or other drive means (not illustrated) drives S-rolls 28 and 29 at the same web surface speed as the web speed through operation station 28.

Each web roll 12–16 and 18–21 is operably connected to a drive sprocket 31–39, by each being mounted to a shaft common to its respective drive sprocket. Each drive sprocket 31–39 has a pitch diameter equal to the roll diameter of its respective web roll 12–16 and 18–21. A continuous or endless chain 40 is looped about drive sprockets 31–39 in the same manner as web 24 is looped about web rolls 12–16 and 18–21. Inlet drive means drives inlet drive sprocket 31 and drive chain 40 at the inlet web speed. Exit drive means drives exit drive sprocket 35 and drive chain 40 at the same speed as the exit web speed.

The accumulator 11 further includes first and second sets of take-up sprockets 41–49 positioned in a mirrored relationship to the drive sprockets 31–39. Thus, the first set of take-up sprockets 41–45 are rotatably mounted to the upper part of frame 17 in a mirrored relationship to the first set of drive sprockets 31–35, and the second set of take-up sprockets 46–49 are rotatably mounted to carriage 22 in a mirrored relationship to the second set of drive sprockets 36–39.

When the accumulator 11 is in operation and the parent roll 25 is being unwound at the same surface speed as web 24 is passing into operation station 8, all of the web rolls 12–16 and 18–21 rotate at the same speed and the carriage remains stationary. If the exit speed of web 24 becomes faster than the inlet speed of web 24, drive chain 40 will be driven faster by exit drive sprocket 35 than by inlet drive sprocket 31. Accordingly, the festooned length of drive chain 40 about the take-up sprockets 12–16 and 18–21 (along the route taken by web 24) will be shortened, resulting in carriage 22 being pulled downwardly towards the first set of web rolls 12–16. At the same time, the festooned length of drive chain 40 about the take-up sprockets 41–49 will be lengthened, resulting in the carriage 22 being permitted to move downwardly. Since drive chain 40 is looped to and from carriage 22 and the first set of take-up sprockets 41–45 the same number of times it is looped to and from carriage 22 and the first set of drive sprockets 31–35, carriage 22 will be pulled downwardly at the same speed that it is permitted to move downwardly. The same operation occurs in reverse when the exit speed of web 24 becomes slower than the inlet speed of web 24. Thus, any difference between the speed of the web 24 entering and the speed of the web 24 leaving the accumulator automatically causes the accumulator to either accumulate or discharge a reserve portion of the web 24. Since inlet web roll 2 and exit web roll 16 are each driven at the same speed as their respective operation stations preceding and following the accumulator 11, any difference in speed between the two operation stations, including halting one while continuing the other, causes the accumulator 11 to automatically accumulate or discharge the required amount of reserve portion of the web 24 to continue operations. Of course, it shall be clear that only a limited amount of web can be accumulated and discharged, so operating speed differences can be accommodated only temporarily.

During discharge of the reserve portion of web 24 from the accumulator 11, carriage 22 will be moving downwardly towards the first set of web rolls 12–16 and the web 24 will be moving at a different speed over each web roll 12–16 and 18–21. To illustrate the speed differences, consider the exit speed of the web to be $V_e$ and the inlet speed of the web to be $V_i$. The carriage speed can be assumed to be $V_c$. $V_c$ is equal to $(V_e - \lambda V_i)/8$, and the web speed at each web roll will be the following:

$$V_{12} = V_i;$$

$$V_{18} = V_i + V_c;$$

$$V_{13} = V_i + 2V_c;$$

$$V_{19} = V_i + 3V_c;$$

$$V_{14} = V_i + 4V_c;$$

$$V_{20} = V_i + 5V_c;$$

$$V_{15} = V_i + 6V_c;$$

$$V_{21} = V_i + 7V_c; \text{ and}$$

$$V_{16} = V_i + 8V_c = V_e.$$

The speed of web 24 at each web roll 12–16 and 18–21 will be the same as the inlet speed of the web 24, $V_i$, and the exit speed of the web 24, $V_e$, just prior to beginning discharge of the reserve portion of the web 24. When discharging begins the sudden change in speed of the web over each web roll 12–16 and 18–21 cannot be tolerated by weak webs if the web rolls obtain their drive force from the web, as they conventionally do in the prior arts. However, in the present invention drive chain 40, being subjected to the same speed changes as the web 24, imparts the drive force to the web rolls and is easily capable of tolerating the speed changes. Furthermore, drive chain 40 will automatically and instantaneously change the speed of each web roll to match the speed of the portion of web 24 passing over it. At the same time, drive chain 40, will automatically and instantaneously move carriage 22 up or down to accumulate or discharge the required length of reserve web to match the speed difference between the web inlet and exit.

Figure 3:
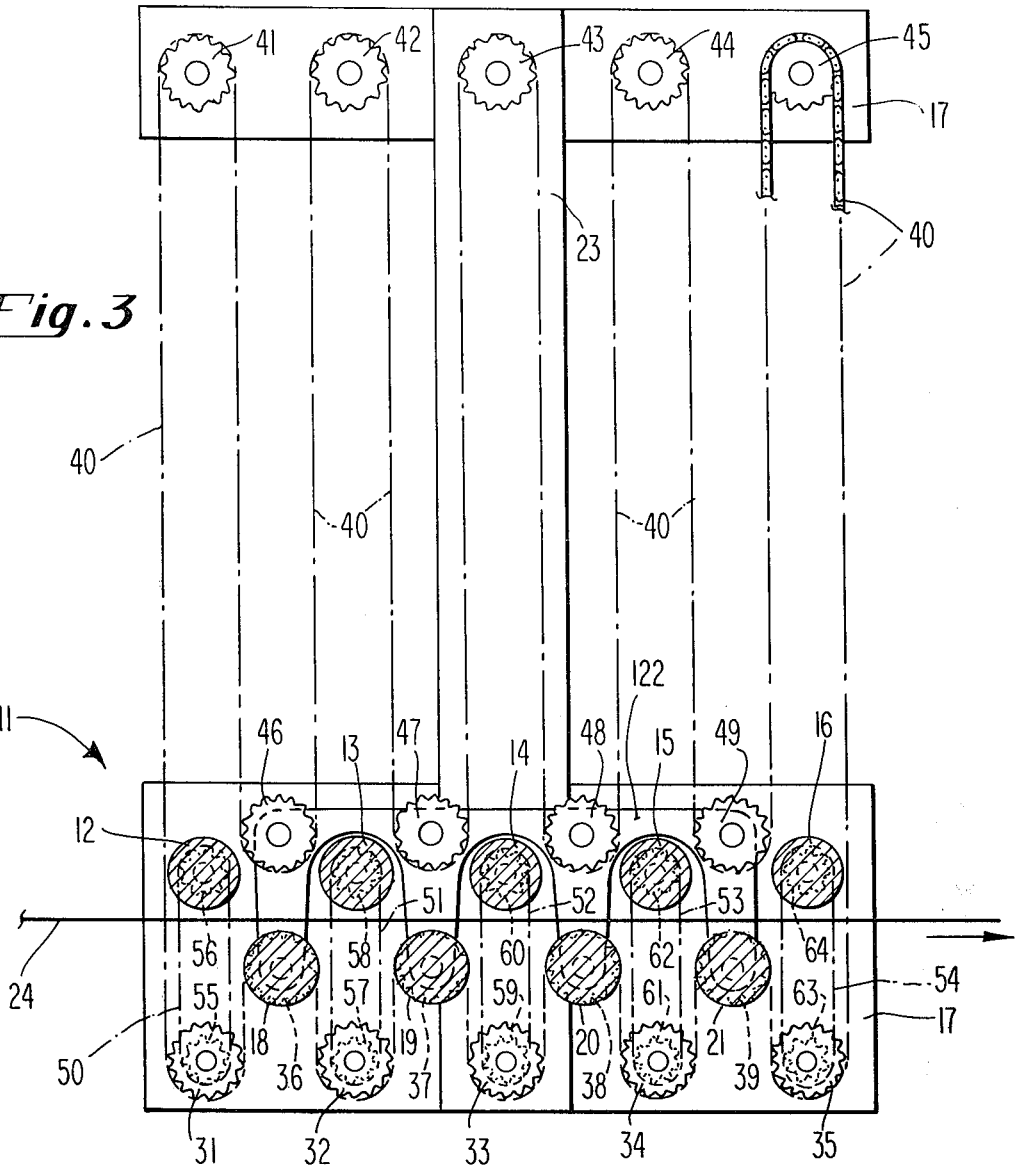
FIG. 3 is a side elevation view of the accumulator illustrated in FIG. 1 modified to have an easy-thread feature.
Figure 4:
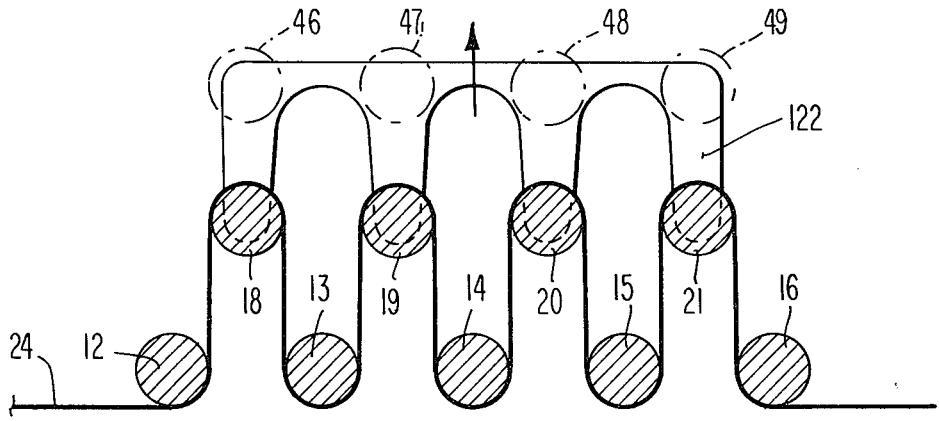
FIG. 4 is a side elevation view of a portion of the apparatus illustrated in FIG. 3, but shown with the carriage in a different position.

FIGS. 3 and 4 illustrate an alternative embodiment of the invention with an easy thread feature. Features having the same indicating numerals as features in other figures are the same. The embodiment of FIGS. 3 and 4 is like that of FIG. 1 with the exceptions set forth in the following description. Carriage 122 is designed to permit the second set of web rolls 18–21 to extend below the first set of web rolls 12–16 when carriage 122 is in its lowermost or threading position (illustrated in FIG. 3). When carriage 122 is in the threading position, web 24 can be threaded straight through the accumulator 11, as illustrated in FIG. 3. After threading, carriage 122 is raised, moving the second set of web rolls 18–21 above the first set of web rolls 12–16, as illustrated in FIG. 4, and automatically causing web 24 to loop alternately about a roll in the first set of web rolls 12–16 and a roll in the second set of web rolls 18–21 in consecutive order.

In the easy thread embodiment illustrated in FIGS. 3 and 4, each of the first set of drive sprockets 31–35 is rotatably mounted below its respective web roll 12–16 and in a position lower than the threading position of second set of web rolls 18–21. In this arrangement, endless drive chain 40 will not fall from the first set of drive sprockets 31–35 when carriage 122 is in the threading position. It can be appreciated that drive chain 40 would drop away from the first set of drive sprockets 31–35 during threading if they were coaxially mounted with the first set of drive rolls 12–16, as they are in the FIG. 1 embodiment.

Each of the first set of drive sprockets 31–35 is operatively connected to its respective web roll 12–16 by auxiliary drive means provided by auxiliary drive chains 50–54 engaging respective pairs of auxiliary drive sprockets 55 and 56, 57 and 58, 59 and 60, 61 and 62, and 63 and 64. It is not necessary for auxiliary drive sprockets 55–64 to have the same sizes as the first set of drive sprockets 31–35, but the two sprockets of each matching pair (55 and 56, 57 and 58, 59 and 60, 61 and 62, and 63 and 64) should be of equal size so that each web roll 12–16 is driven at the same surface speed as its respective drive sprocket 31–35. Although the first set of drive sprockets 31–35 has been illustrated as being positioned below its respective web rolls (the first set 12–16), it should be recognized that other arrangements are possible. For example, each of the second set of drive sprockets 36–39 could be positioned above its respective web rolls (the second set 18–21) with interconnecting auxiliary drive means similar to that illustrated for the first set. It is only necessary for each drive sprocket connected to one set of the web rolls to be in a position not passed by the web rolls in the other set when the web rolls are moved into the threading position, to assure that drive chain 40 remains engaged with the drive sprocket.

Figure 5:
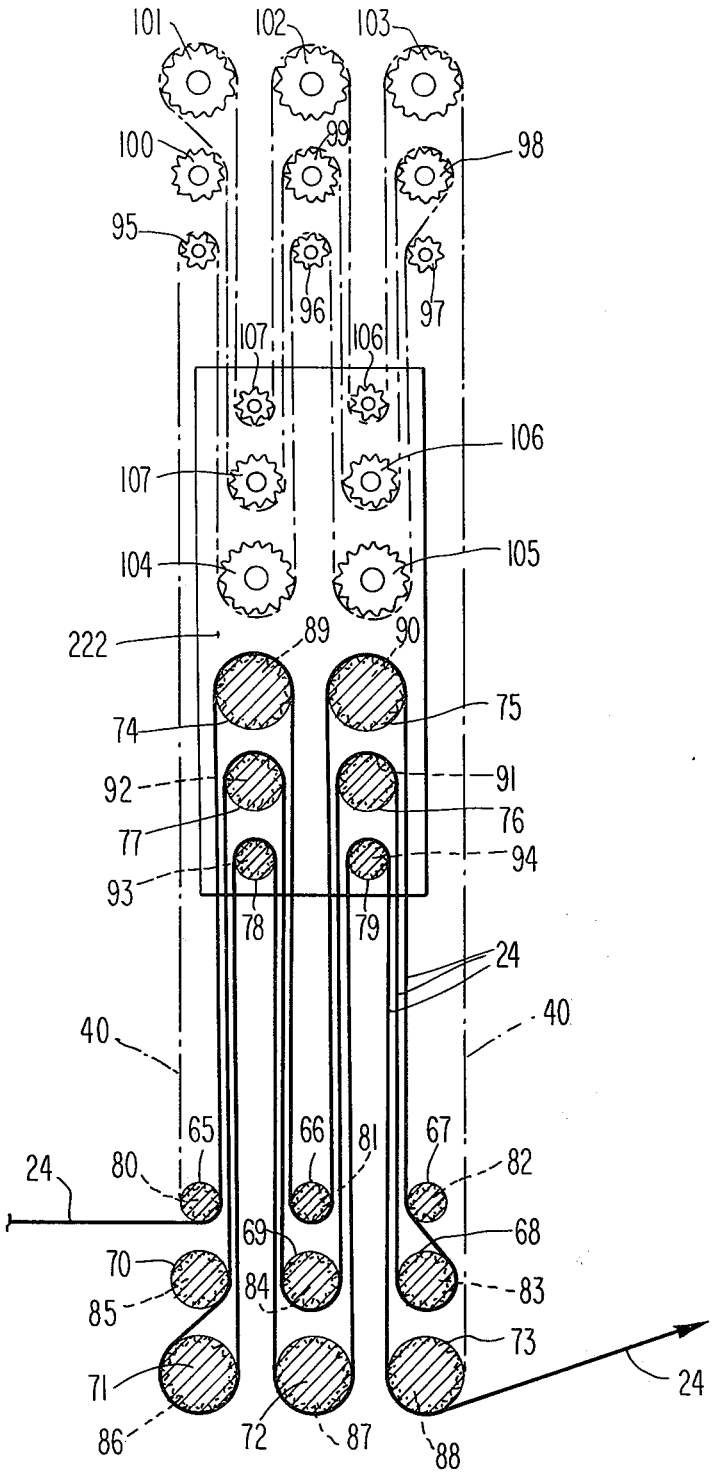
FIG. 5 is a schematic illustration of the accumulator of the invention in an embodiment which permits a greater accumulation of web reserve.

FIG. 5 illustrates another embodiment of the invention in which the web rolls in each set are positioned in tiers to permit a greater accumulation of the web for the same size accumulator. FIG. 5 only illustrates the arrangement of the web rolls, the drive sprockets, the take-up sprockets, and the carriage since all other parts could be similar to those illustrated in FIGS. 1 and 2. In this arrangement, the first set of web rolls are provided by rolls 65–73 rotatably mounted at the bottom of the frame of the accumulator in three tiers of three rolls each. In similar fashion, the second set of web rolls 74–79 are mounted in three tiers of two rolls each on carriage 222. The web rolls in each tier are larger than the web rolls in the adjacent tier closest to the opposing set of web rolls for permitting web 24 and drive chain 40 to be looped from set to set without interfering with other loops. Web rolls 67 and 70 in the first set of web rolls 65–73 are employed only for alignment of web 24 and drive chain 40 and are not functional web rolls for festooning. Operatively connected to each web roll 65–79 is a drive sprocket 80–94 with a pitch diameter equal to the surface diameter of its respective web roll 65–79.

In similar fashion to the other embodiments of the invention, the accumulator of FIG. 5 includes take-up sprockets in a first set 95–103 rotatably mounted at the top of the accumulator frame and a second set of take-up sprockets 104–109 rotatably mounted on carriage 222. The take-up sprockets 95–109 are mounted in a mirrored relationship to the drive sprockets 80–94. Endless drive chain 40 is threaded about drive sprockets 80–94 in the same manner that the web 24 is threaded about web rolls 65–79. Drive chain 40 then continues up to take-up sprockets 95–109 and loops about them in a mirrored relationship to its path about drive sprockets 80–94.

Having described the preferred embodiments of the invention, it should be recognized that many variations can be employed within the scope of the invention. For example, many forms of flexible drive belt can be used in the invention, a chain being described only as a preferable form. Likewise, other forms of drive pulleys which are compatible with the form of drive belt can be employed, sprockets having been described for use with a chain.

A preferred form of the invention, as described above, includes take-up sprockets positioned in a mirrored relationship to the drive sprockets and about which the endless, flexible drive belt festoons. Mirrored relationship for the invention means that each drive pulley has a corresponding take-up pulley positioned in the same relative position at the opposite part of the accumulator. The importance of the mirrored relationship is that the number of drive belt loops from the carriage to the fixed set of drive pulleys is equal to the number from the carriage to the fixed set of take-up pulleys. Thus, the carriage will be permitted to move in a direction at the same speed it is pulled in that direction. The relative sizes of the take-up pulleys is not critical, since they each rotate freely.

The mirrored relationship arrangement conveniently accomplishes two beneficial results. It takes up and lets out portions of the drive belt to correspond to the increasing or decreasing length of the drive belt festooned about the drive sprockets and it pulls the second set of web rolls away from the first set of web rolls when the accumulator is accumulating a reserve portion of web. However, it should be recognized that other forms of drive belt take-up means could accomplish these same results, although perhaps not as conveniently. For example, a single, movably mounted pulley biased in a direction to take up increasing belt length could be used in combination with biasing means such as springs or weights.

Furthermore, even when the drive belt take-up means are provided by take-up sprockets positioned in a mirrored relationship to the drive sprockets, the second set of take-up sprockets mounted on the carriage does not have to be mounted away from the second set of drive sprockets mounted on the carriage. When each of the second set of take-up sprockets and its respective drive sprocket are of the second set are chosen to be of equal size they could be coaxially mounted to the same shaft, since they will be driven in the same direction at the same speed. However, where the flexible drive belt is provided by a chain, it is advantageous to mount the second set of take-up sprockets above the second set of drive sprockets and in the same plane, since chains are generally flexible in only one plane.

It should also be recognized that in the broadest sense the invention does not require a single carriage upon which all of the web rolls in the second set are mounted. Each web roll could be independently mounted, although equal movement of each of the second set of web rolls towards or away from the first set of web rolls can be most easily assured by mounting all of the second set of web rolls on a common carriage, as illustrated in the drawings.

The invention has been described in its preferred forms which provide several novel features, each of which are quite advantageous alone and particularly so when used in combination with each other. Those features are described in the following claims.

I claim:

1. A web accumulator for accumulating and discharging a reserve portion of a continuous web passing through the accumulator in order to compensate for the difference between an inlet speed and an outlet speed of the web, the accumulator comprising:

first and second sets of rotatably mounted web rolls, each of which is partially wrapped by the web when the web is looped alternately from a roll of the first set to a roll of the second set in consecutive order, the second set of rolls being mounted for movement with respect to the first set of rolls;

means responsive to the inlet and outlet speed of the web for moving the second set of web rolls towards the first set of web rolls to discharge the reserve portion of the web when the outlet speed exceeds the inlet speed and for moving the second set of web rolls away from the first set of web rolls to accumulate the reserve portion of the web; and web roll drive means separate from the web for rotating each roll at the speed of the web portion in contact with it when discharging and accumulating the reserve portion of the web.

2. The accumulator described in claim 1, wherein the web roll drive means comprises:

a plurality of drive pulleys providing a drive pulley operatively connected to each web roll for rotating its respective web roll, each drive pulley having a pitch diameter equal to the diameter of the web roll it drives;

an endless flexible drive belt operatively engaging the drive pulleys in the same sequence as the web engages the web roll; and drive belt take-up means for taking up and releasing slack in the drive belt occurring when the second set of web rolls moves towards or away from the first set of web rolls.

3. A web accumulator for accumulating and discharging a reserve portion of a continuous web passing through the accumulator, the accumulator comprising:

first and second sets of rotatably mounted web rolls, each of which is partially wrapped by the web when the web is looped alternately from a roll of the first set to a roll of the second set in consecutive order, the second set of rolls being mounted for movement with respect to the first set of rolls;

means for moving the second set of web rolls towards and away from the first set of web rolls to discharge and accumulate the reserve portion of the web;

a plurality of drive pulleys providing a drive pulley operatively connected to each web roll for rotating its respective web roll, each drive pulley having a pitch diameter equal to the diameter of the web roll it drives;

an endless flexible drive belt operatively engaging the drive pulleys in the same sequence as the web engages the web roll;

drive belt take-up means for taking up and releasing slack in the drive belt occurring when the second set of web rolls moves towards or away from the first set of web rolls;

exit drive means for rotating the last web roll in the accumulator at an exit speed; and inlet drive means for rotating the first web roll in the accumulator at an inlet speed.

4. A web accumulator described in claim 3, further including a carriage mounted for movement towards and away from the first set of web rolls and upon which the second set of web rolls is mounted, whereby the carriage and the second set of web rolls are moved towards the first set of web rolls when the exit speed is greater than the inlet speed, and the accumulator further includes means for moving the carriage away from the first set of web rolls when the inlet speed is greater than the exit speed.

5. A web accumulator for accumulating and discharging a reserve portion of a continuous web passing through the accumulator, the accumulator comprising:

first and second sets of rotatably mounted web rolls, each of which is partially wrapped by the web when the web is looped alternately from a roll of the first set to a roll of the second set in consecutive order;

exit drive means for rotating the last web roll in the accumulator at an exit speed;

inlet drive means for rotating the first web roll in the accumulator at an inlet speed;

a carriage mounted for movement towards and away from the first set of web rolls and upon which the second set of web rolls is mounted; and carriage drive means separate from the web and operatively connected to the exit drive means and inlet drive means for moving the carriage towards and away from the first set of web rolls in response to the difference in exit speed and inlet speed, whereby the web is accumulated when the inlet speed is greater than the exit speed and the web is discharged when the exit speed is greater than the inlet speed.

6. The web accumulator described in claim 5, wherein the carriage drive means comprises a flexible belt driven by the exit drive means and the inlet drive means and following the same path as the web passing through the accumulator.

7. A web accumulator for accumulating and discharging a reserve portion of a continuous web passing through the accumulator, the accumulator comprising:

first and second sets of rotatably mounted web rolls, each of which is partially wrapped by the web when the web is wound alternately from a roll of the first set to a roll of the second set in consecutive order;

mounting means upon which the second set of web rolls is mounted for movement towards the first set of web rolls in a discharge direction to discharge the reserve portion of the web and for movement away from the first set of web rolls to accumulate the reserve portion of the web, the mounting means permitting the second set of web rolls to move in the discharge direction past the first set of web rolls to a threading position for threading the web through the accumulator;

a plurality of drive pulleys providing a drive pulley operatively connected to each of the web rolls for rotating its respective web roll;

an endless flexible drive belt operatively engaging the drive pulleys in the same sequence as the web engages the web roll;

drive belt take-up means for taking up and releasing slack in the drive belt occurring when the second set of web rolls moves towards and away from the first set of web rolls; and means for positioning each drive pulley connected to one set of the web rolls in a position which is not passed by the web rolls of the other set when the second set of web rolls is moved into the threading position, whereby the drive belt remains engaged with the drive pulleys.

8. A web accumulator for accumulating and discharging a reserve portion of a continuous web passing through the accumulator, the accumulator comprising:

first and second sets of rotatably mounted web rolls, each of which is partially wrapped by the web when the web is wound alternately from a roll of the first set to a roll of the second set in consecutive order;

exit drive means for rotating the last web roll in the accumulator at an exit speed;

inlet drive means for rotating the first web roll in the accumulator at an exit speed;

inlet drive means for rotating the first web roll in the accumulator at an inlet speed;

a carriage mounted for movement towards and away from the first set of web rolls and upon which the second set of web rolls is mounted;

a plurality of drive pulleys providing a drive pulley operatively connected to each web roll for rotating its respective web roll, each drive pulley having a pitch diameter equal to the diameter of the web roll it drives;

a plurality of take-up pulleys rotatably mounted in a mirrored relationship to the drive pulleys; and an endless flexible drive belt operatively engaging the drive pulleys in the same sequence as the web engages the web rolls and extending into operable engagement with the take-up pulleys in a mirrored relationship to its engagement with the drive pulleys, whereby a difference between the inlet and outlet speeds of the accumulator causes movement of the carriage to accumulate or discharge the reserve portion of the web and drives each web roll at the speed of the web portion in contact with it.

* * * * *